United States Patent [19]

Kobayashi

[11] 4,135,073

[45] Jan. 16, 1979

[54] DEVICE FOR INDICATING SWITCH OPERATION BY VARIABLE ILLUMINATING LIGHT

[75] Inventor: Mitsuo Kobayashi, Gifu, Japan

[73] Assignee: Kabushiki Kaisha Tokai Rika Denki Seisakusho, Aichi, Japan

[21] Appl. No.: 887,203

[22] Filed: Mar. 15, 1978

[30] Foreign Application Priority Data

Mar. 15, 1977 [JP] Japan ..... 52/31378[U]

[51] Int. Cl.[2] ..... H01H 9/00

[52] U.S. Cl. ..... 200/315; 200/313

[58] Field of Search ..... 200/315, 310, 311, 312, 200/313, 315, 317

[56] References Cited

U.S. PATENT DOCUMENTS 2,701,286 2/1955 Slate et al. ..... 200/316

3,766,349 10/1973 Codrino ..... 200/315

*Primary Examiner*—William T. Dixson, Jr.
*Assistant Examiner*—Steven M. Pollard
*Attorney, Agent, or Firm*—Koda and Androlia

[57] ABSTRACT

A device for indicating switch operation by variable illuminating light including a switch case, a means for controlling the switch operation provided on the case, a light transmitting window provided in the controlling means, an illuminating lamp installed in the switch case for illuminating through the light transmitting window, a moveable plate interposed between the light transmitting window and the illuminating lamp and being actuated in response to the controlling means and a light control aperture provided in the moveable plate for changing the character of the illuminating light through the light transmitting window in accordance with the actuation of the moveable plate.

10 Claims, 4 Drawing Figures

DEVICE FOR INDICATING SWITCH OPERATION BY VARIABLE ILLUMINATING LIGHT

BACKGROUND OF THE INVENTION

1. Field of Invention

The present invention relates to devices for indicating switch operation and more particularly to devices for indicating switch operation by varying illuminating light.

2. Prior Art

In the prior art there are devices for indicating the operation of a switch. Such indication devices include placing markings on the switch which indicate by the position of the switch actuation means the operation of the switch. This type of switch is not useful in environments wherein the light is very dim. To overcome the disadvantages of the above-described advice, switches have been developed which indicate an on condition by lighting up and an off condition by going out. Such switches are more useful in low light environments but provide another disadvantage. This disadvantage is that when it is completely dark and the switch is completely out, it is very difficult to find the switch in the darkness.

SUMMARY OF THE INVENTION

Accordingly it is the general object of the present invention to provide a device for indicating the operation of a switch by other means than merely lighting up when the switch is operated to the on state.

It is yet another object of the present invention to provide a device for indicating the operation of a switch by varying the luminesce intensity or color of the illuminating light from the switch.

It is yet another object of the present invention to provide a device for indicating the operation of a switch which is simple.

It is another object of the present invention to provide a device for indicating the operation of a switch which is suitable for use in low light environments.

In keeping with the principles of the present invention the objects are accomplished by a unique device for indicating the operation of a switch by variable light including a switch case, a device for controlling the switch operation provided on the case, a light trnasmitting window provided in the controlling means, an illuminating lamp installed in the switch case for illuminating through the light transmitting window, a moveable plate interposed between the light transmitting window and the illuminating lamp and being actuated in response to the controlling means and a light control aperture provided in the moveable plate for changing the character of the illuminating light through the light transmitting window in accordance with the actuation of the moveable plate.

In the preferred embodiment the controlling means comprises a knob oscillatingly or slideably provided in the switch and the light control aperture controls the character of the light by changing either the light intensity or the color.

BRIEF DESCRIPTION OF THE DRAWINGS

The above mentioned features and objects of the present invention will become more apparent with reference to the following description taken in conjunction with the accompanying drawings wherein like referenced numerals denote like elements and in which.

DETAILED DESCRIPTION OF THE INVENTION

Figure 3:
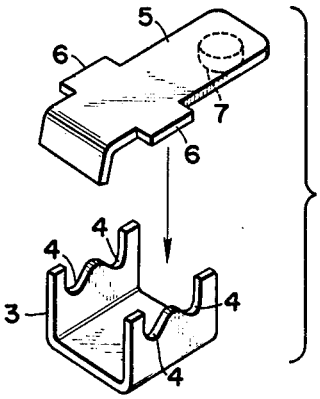
FIG. 3 is an oblique view illustrating a terminal block and moveable contact member in accordance with the teachings of the present invention.
Figure 4:
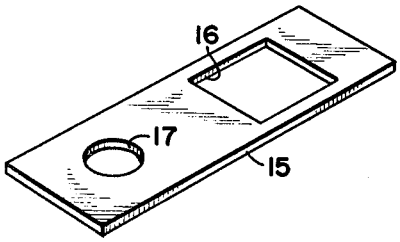
FIG. 4 is an oblique view illustrating a moveable plate in accordance with the teachings of the present invention.

Referring more particularly to the drawings, shown therein is one embodiment of a device for indicating the operation of a switch in accordance with the teachings of the present invention. In the figures the device for indicating the operation of a switch includes an oscillating switch A having a switch operation control knob 19 and a switch case 1 formed in the shape of a box at a large depth. The switch case 1 has an insulating plate 2 provided in the bottom thereof. Installed on the insulating plate 2 are a terminal block 3 formed in the shape of a letter U and provided at opposite side walls thereof with support cut-outs 4 and a fixed contact 8 as shown in FIG. 3. A moveable contact member 5 is mounted on the terminal block 3 in such a manner that the contact member 5 is coupled into a space formed between the opposite side walls and projecting wing pieces 6 on the member 5 are coupled to the support cut-outs 4 to thereby ocsillatingly support the contact member 5.

A moveable contact 7 formed at the oscillating end of the contact 5 is adapted to be connected or disconnected from the fixed contact 8 so as to form a make or break contact. A socket 10 for an illuminating lamp which is constantly on is inserted into the insulating plate 2 at a portion adjacent to terminal block 3. Additionally, the switch case 1 is integrally formed with a partition wall 11 disposed downwardly of the upper opening thereof and spaced apart from the insulating plate 2. The partition wall 11 is provided therein with a working hole 12 corresponding to the moveable contact member 5 and with an aperture 13 of a comparatively small diameter. The aperture 13 corresponds to and is directly over the lamp 9.

Slideable on the partition wall 11 is provided a moveable plate 15. An engageable hole 16 is provided through the moveable plate 15 and corresponds to the working hole 12. A small aperture 17 corresponding to the aperture 13 is also provided in the moveable plate 15. The aperture 17 is adapted to partially obstruct the aperture 13 (see FIG. 1) or match with the aperture 13 (see FIG. 2).

Figure 1:
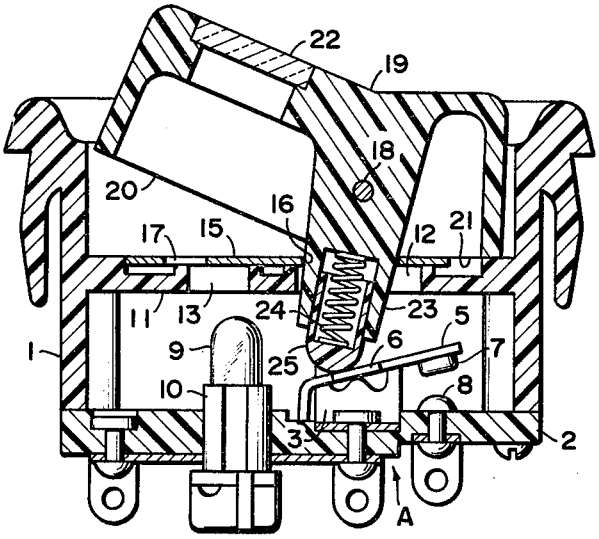
FIGS. 1 and 2 are longitudinal side sectional views illustrating a device for indicating the operation of a switch in accordance with the teachings of the present invention.
Figure 2:
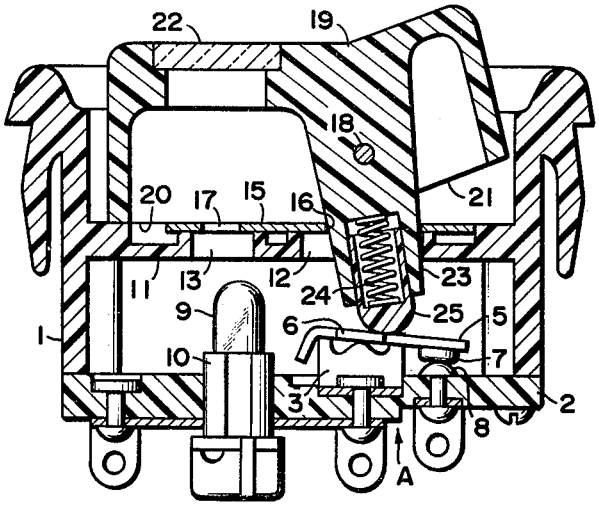

A pivot pin 18 is provided through the switch case 1 at a portion upwardly of the working hole 12. Oscillatingly pivoted on the pivotal pin 18 is a see-saw type knob 19 whose inclined bottom surfaces 20 and 21 alternately contact or settle on the partition wall 11 as shown in FIGS. 1 and 2. The knob 19 is formed at the upper surface thereof with a warp of an obtuse angle. Furthermore, the knob 19 is provided with a light transmitting window 22 corresponding to and directly over the aperture 13. The knob 19 is further provided at a portion downwardly of the pivot pin 18 with an oscillating arm 13 which extends through the working hole 12 in the partition wall 11. The oscillating arm 23 is formed at the bottom face thereof with a blind hole into which a spring 24 and a quick motion engageable element 25 are provided. The quick motion engageable element 25 resiliently contacts the moveable contact member 5. The oscillating arm 23 is inserted through an aperture hole 16 of the moveable plate 15 to engage the moveable plate 15 therewith.

It should be apparent that the present embodiment may be modified such that the switch case 1 is provided with an upper plate and the knob 19 is adapted to oscillate without interfering with the upper plate. In such a case, the light transmitting window 12 is formed in the upper plate of the switch case 1.

In operation, when one side of the upper surface of the knob 19 is pressed to oscillate the knob 19 as is shown in FIG. 1 the quick motion engageable element 25 of the oscillating arm 23 moves along the moveable contact member 5 to affect a switch-off action to disconnect the contact 7 from the contact 8 and at the same time the moveable plate 15 which is interlocked to the oscillating arm 23 to move to thereby cause the aperture 17 to partially obstruct the aperture 13. As a result, the light from the illuminating lamp is restricted and the lamp 9 illuminates the light transmitting window 22 from the inside with a smaller volume of light.

Furthermore, if the knob 19 is oscillated as shown in FIG. 2, then due to the movement of the quick motion engageable element 25, the moveable contact 5 is oscillated to thereby affect a switch on action to connect the moveable contact to the fixed contact 8. At the same time, the moveable plate is moved by the oscillating arm 23 to thereby cause the aperture 17 of the moveable plate 15 to match with the aperture 13 and the lamp 9 illuminates the lamp transmitting window 22 from the inside with a larger volume of light.

The above description illustrates one embodiment wherein the illuminating light volume from the illuminating lamp is made variable depending on the switch operation to thereby indicate the operation of the switch by the illuminating lamp. It should be apparent that the moveable plate 15 could be formed with two apertures 17 in such a manner that either one of the two apertures could alternately match with the aperture 13 in the two positions as shown in FIGS. 1 and 2. In this case the two apertures 17 could be provided with two different colored glasses or lenses to thereby give the light passing therethrough different colors.

Additionally, it should be apparent that the knob 19 could be so constructed as to slide on the partition wall 11 and the slideable knob 19 could be provided therein with a light transmitting window 22 similar to that described above so that the light volume or the color of the light could be changed.

It should be apparent from the above description that the device for indicating the operation of a switch in accordance with the teachings of the present invention has certain advantages. In particular since the illuminating light does not light up or go out depending on the switch operation and the operation of the lamp is indicated either by the light volume or a change in the color of the illuminating lamp, such a device in accordance with the teachings of the present invention can be utilized in a comparatively dark place such as a motor vehicle. In addition, since the light is constantly on though the light volume may be low, the switch operation can be definitely indicated by a variable illuminating light and it is easy to know the state of the operation of the switch.

It should be apparent to one skilled in the art that the above described embodiments are merely illustrative of but one of the many possible specific embodiments which represent applications of the principles of the present invention. Numerous and varied other arrangements can be readily devised by those skilled in the art without departing from the spirit and scope of the invention.

I claim:

1. A device for indicating a switch operation by a variable illuminating light comprising:

a switch case;

a means for controlling operation of the switch provided on the case;

a light transmitting window provided in the controlling means;

an illuminating lamp provided in the switch case for illuminating through said light transmitting window;

a movable plate interposed between the light transmitting window and the illuminating lamp and actuated in response to the controlling means; and a light control aperture provided in the movable plate for changing the character of the illuminated light through the light transmitting window in accordance with the actuation of the movable plate.

2. A device for indicating switch operation by a variable illuminating light comprising:

a switch case;

an illuminating lamp installed in the switch case for illumination;

a knob having a light transmit window, and installed in the switch case for controlling the switch operation; and a movable plate interposed between said light transmit window and the illuminating lamp and interlocked with the knob so as to be displaced, said movable plate being provided with at least one illuminating light control aperture in order to change the light in light volume or color in accordance with the displacement of said movable plate.

3. A device for indicating switch operation by a variable illuminating light according to claim 2, wherein said movable plate is adapted to slide ona partition wall interposed between said light transmitting window and illuminating lamp, said partition wall having an aperture so as to transmit light to the light transmitting window.

4. A device for indicating switch operation by a variable illuminating light as claimed in claim 3, wherein said knob is slidably supported on the switch case.

5. A device for indicating switch operation by a variable illuminating light as claimed in claim 4, wherein said movable plate is integrally formed on said knob.

6. A device for indicating switch operation by a variable illuminating light according to claim 2, wherein said illuminating light control apertures of the movable plate have different colored light transmitting materials respectively so as to change the color of the illuminating light in accordance with the displacement of the movable plate.

7. A device for indicating switch operation by a variable illuminating light according to claim 2, wherein said knob is swingably supported on the switch case.

8. A device for indicating switch operation by a variable illuminating light according to claim 7, wherein the knob is adapted to move in click motion.

9. A device for indicating switch operation by a variable illuminating light according to claim 8, wherein the knob is integrally provided with an oscillating arm penetrating an engagable hole of the movable plate.

10. A device for indicating switch operation by a variable illuminating light according to claim 9, wherein bottom surfaces of a skirt wall of the knob are inclined respectively so as to alternately abut against the partition wall of the switch case.

* * * * *